US005143336A

United States Patent [19]

McMichael

[11] Patent Number: 5,143,336

[45] Date of Patent: Sep. 1, 1992

[54] CURTAIN ROD MOUNTING ASSEMBLY

[75] Inventor: Dannie L. McMichael, West Kingston, R.I.

[73] Assignee: Kenney Manufacturing Company, Warwick, R.I.

[21] Appl. No.: 618,107

[22] Filed: Nov. 26, 1990

[51] Int. Cl.[5] ..... A47H 15/00

[52] U.S. Cl. ..... 248/265; 248/260

[58] Field of Search ..... 248/265, 263, 261, 251, 248/255, 259, 260; 160/330, 340

[56] References Cited

U.S. PATENT DOCUMENTS

| | | | |
|---|---|---|---|
| 388,151 | 8/1888 | Reubel et al. . | |
| 443,175 | 12/1890 | Gilbert . | |
| 613,185 | 10/1898 | Anderson . | |
| 743,712 | 11/1903 | Gimenez . | |
| 903,475 | 11/1908 | Jacoby . | |
| 974,524 | 11/1910 | Roehm . | |
| 1,079,641 | 11/1913 | Drake . | |
| 1,242,849 | 10/1917 | Parris . | |
| 1,358,571 | 11/1920 | Patrick . | |
| 1,453,502 | 5/1923 | Hinderliter . | |
| 1,533,302 | 4/1925 | Boye . | |
| 1,694,154 | 12/1928 | Westendorf . | |
| 2,185,385 | 1/1940 | Rose . | |
| 2,464,325 | 3/1949 | Lynn . | |
| 2,545,147 | 3/1951 | Jensen . | |
| 2,677,523 | 5/1954 | Henley . | |
| 2,680,589 | 6/1954 | Nelson . | |
| 2,783,014 | 2/1957 | Kenney | 248/265 X |
| 2,913,213 | 11/1959 | Folker . | |
| 2,931,612 | 4/1960 | Graber . | |
| 3,095,033 | 6/1963 | Polkosnik | 248/265 X |
| 3,197,823 | 8/1965 | Ennis . | |
| 3,430,908 | 3/1969 | Kowalczyk | 248/265 |
| 4,235,406 | 11/1980 | Vecchiarelli . | |
| 4,352,433 | 10/1982 | Ford . | |
| 4,455,692 | 6/1984 | Hegge et al. . | |
| 4,580,753 | 4/1986 | Hennequin . | |
| 4,635,889 | 1/1987 | Bell et al. . | |
| 4,747,182 | 5/1988 | Darner . | |
| 4,824,062 | 4/1989 | Wagner . | |
| 4,967,991 | 11/1990 | Simon | 248/265 |

*Primary Examiner*—Karen J. Chotkowski

*Attorney, Agent, or Firm*—Richard A. Inz

[57] ABSTRACT

This invention relates to a curtain rod mounting assembly. The configuration of the mounting clip allows one or two base members to be mounted thereon. Either a curtain rod member or a valance extender can be inserted into the base member. A plurality of valance extenders can be used to increase the distance that the curtain rod bracket is from the window. The base members valance extenders and curtain rod mounting brackets are provided with means that allow for precise and simple positioning of the curtain rod mounting bracket from the window frame.

5 Claims, 4 Drawing Sheets

FIG. 1
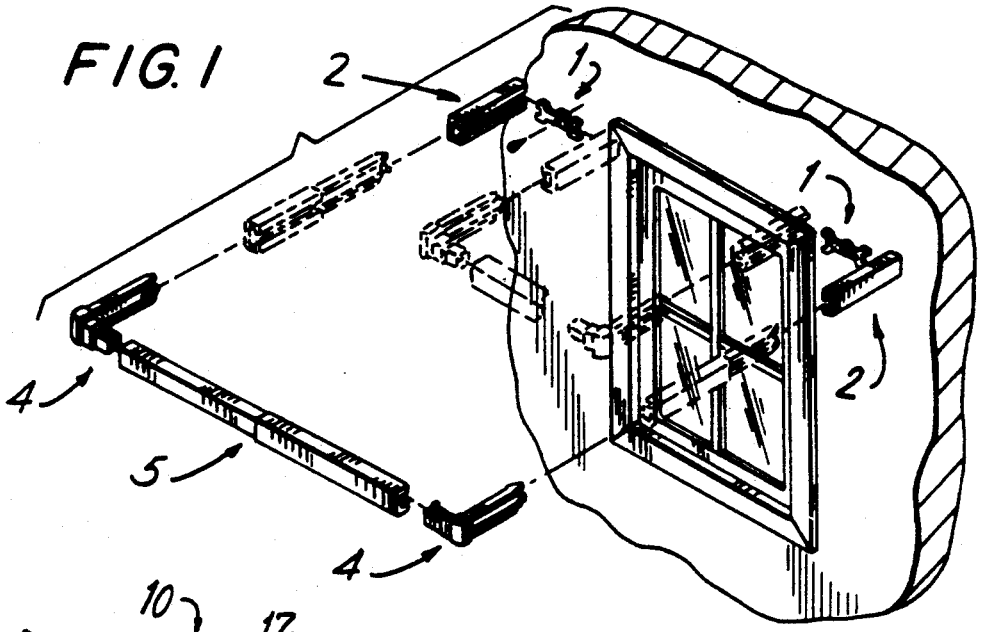
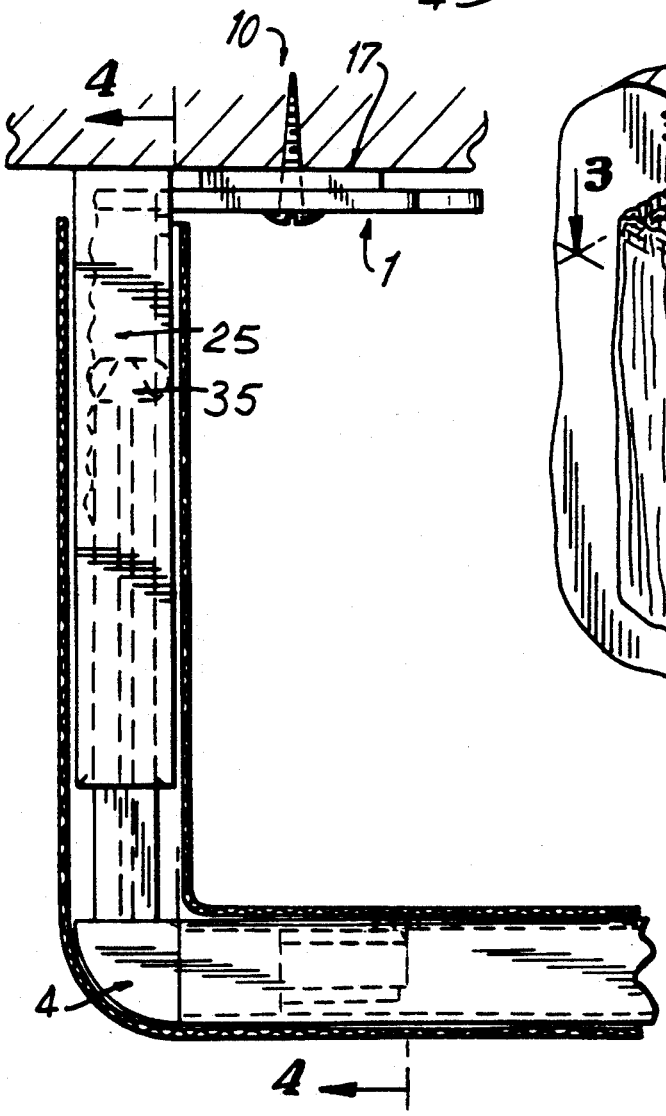
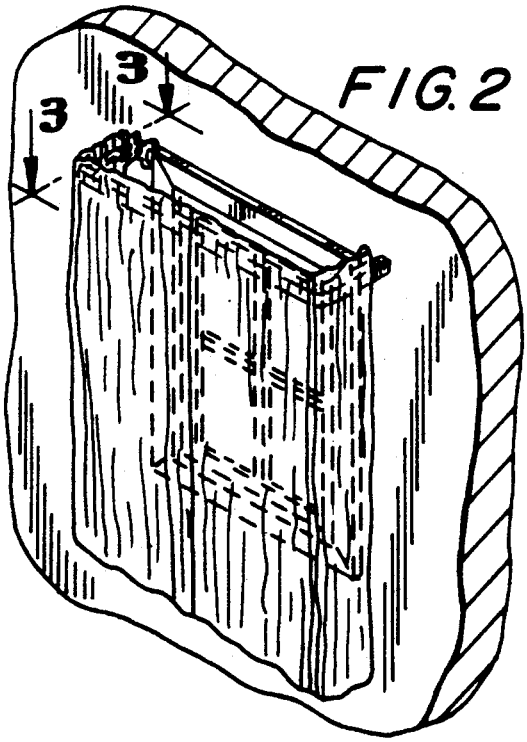
FIG. 2
FIG. 3

CURTAIN ROD MOUNTING ASSEMBLY

BACKGROUND OF THE INVENTION

Curtain rod mounting assemblies generally have an elongated support rod on which curtains or a valance may be hung. The support rod is typically formed from an extruded metal or plastic member and is generally mounted on spaced apart wall brackets. In addition, the support rod is generally mounted at a distance from the wall surface around the window opening or other area for which the curtain is to form a closure.

Present curtain rod mounting assemblies generally are somewhat difficult to assemble and mount on wall brackets. In addition, with present curtain rod mounting assemblies, it is particularly difficult to vary and precisely adjust the distance that the curtain rod is spaced from the window opening. Moreover, it has heretofore been necessary to use additional mounting brackets if an additional curtain or valance treatment is desired for the window opening.

It would therefore be desirable to provide a curtain rod mounting assembly that is relatively simple to assemble and mount on wall brackets.

It also would be desirable to provide a curtain rod mounting assembly that is relatively simple to adjust precisely in order to vary the distance that the curtain rod is spaced from the window opening.

It further would be desirable to provide a curtain rod mounting assembly that obviates the necessity of using additional mounting brackets if an additional curtain or valance treatment is desired for the window opening.

SUMMARY OF THE INVENTION

It is therefore an object of the invention to provide a curtain rod mounting assembly that is relatively simple to assemble and mount on wall brackets.

It is another object of this invention to provide a curtain rod mounting assembly that is relatively simple to adjust precisely in order to vary the distance that the curtain rod is spaced from the window opening.

It is still another object of this invention to provide a curtain rod mounting assembly that obviates the necessity of using additional mounting brackets if an additional curtain or valance treatment is desired for the window opening.

In accordance with this invention, there is provided a curtain rod mounting assembly comprising a mounting clip, one or more base members, one or more valance extenders and one or more curtain rod brackets. The configuration of the mounting clip allows one or two base members to be mounted thereon. Either a curtain rod bracket or a valance extender can be inserted into the base member. A plurality of valance extenders can be used to increase the distance that the curtain rod bracket is to be spaced from the window. The base members, valance extenders and curtain rod brackets are provided with means that provide for relatively simple and precise adjustment of the distance that the curtain rod bracket, and thus the curtain rod, is from the window.

BRIEF DESCRIPTION OF THE DRAWINGS

The above and other objects and advantages of this invention will be apparent upon consideration of the following detailed description, taken in conjunction with the accompanying drawings, in which like reference characters refer to like parts throughout, and in which:

FIG. 1 is an exploded perspective view of the curtain rod mounting assembly of this invention;

FIG. 2 is a perspective view showing a curtain disposed on the curtain rod mounting assembly of this invention;

FIG. 3 is a cross-sectional view of the curtain rod mounting assembly of this invention taken along line 3—3 of FIG. 2;

DETAILED DESCRIPTION OF THE INVENTION

Figure 4:
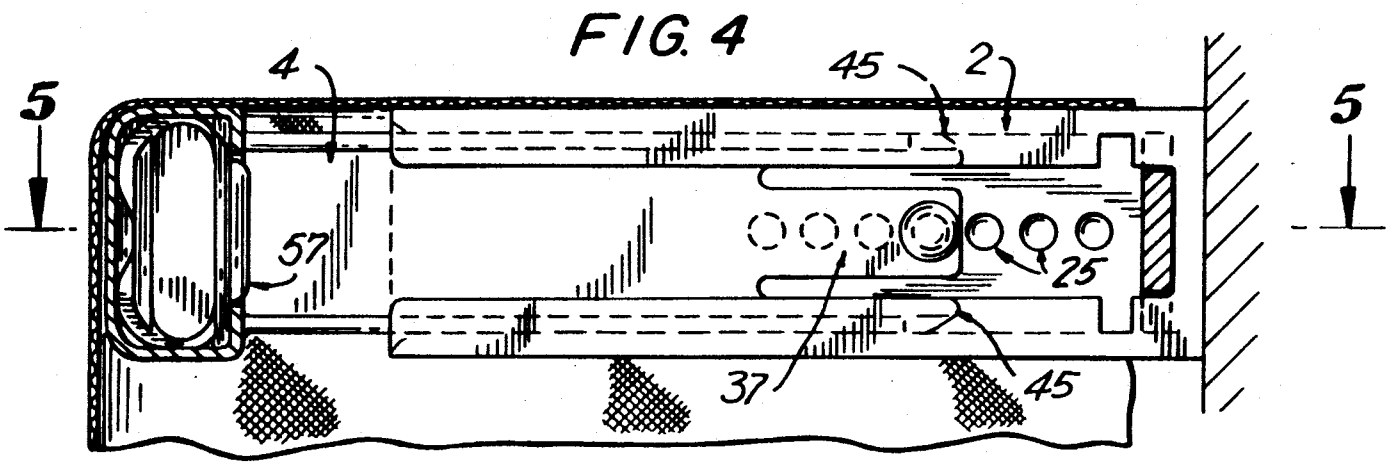
FIG. 4 is a cross-sectional view of the curtain rod mounting assembly of this invention taken along line 4—4 of FIG. 3.
Figure 5:
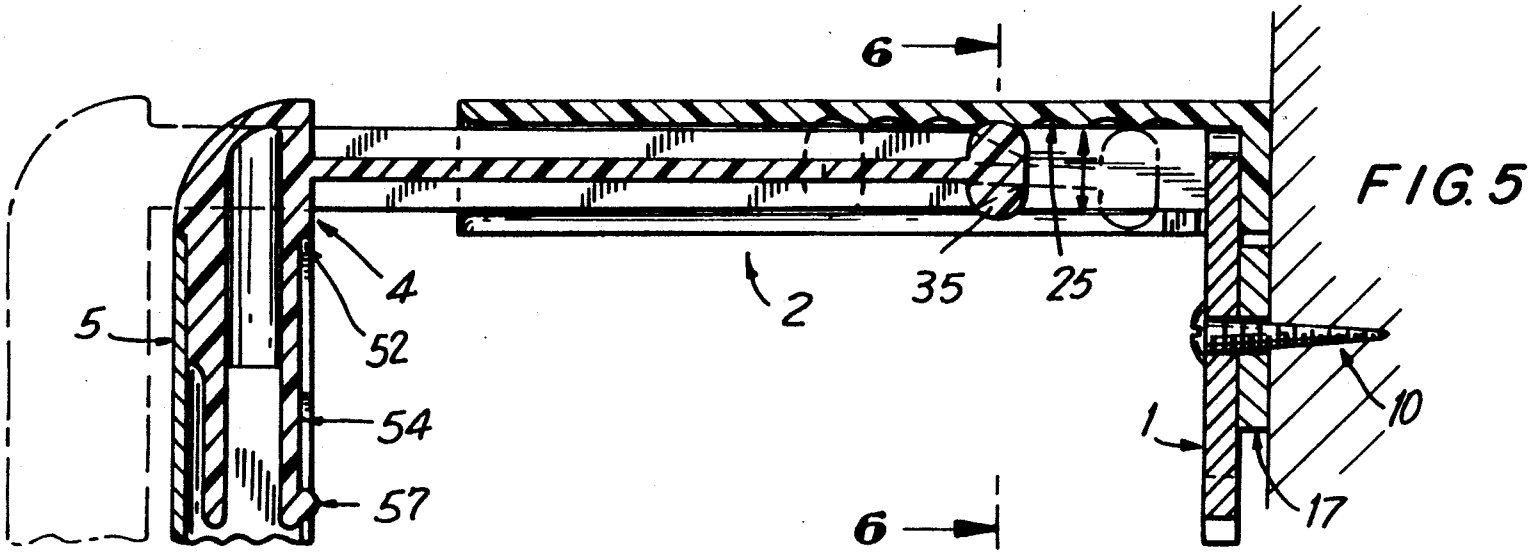
FIG. 5 is a cross-sectional view of the curtain rod mounting assembly of this invention taken along line 5—5 of FIG. 4.
Figure 6:
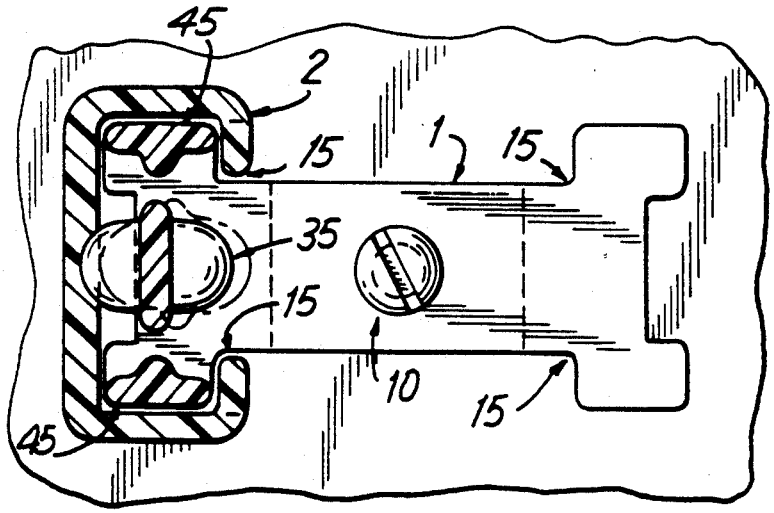
FIG. 6 is a cross-sectional view of the curtain rod mounting assembly of this invention taken along line 6—6 of FIG. 5.
Figure 7:
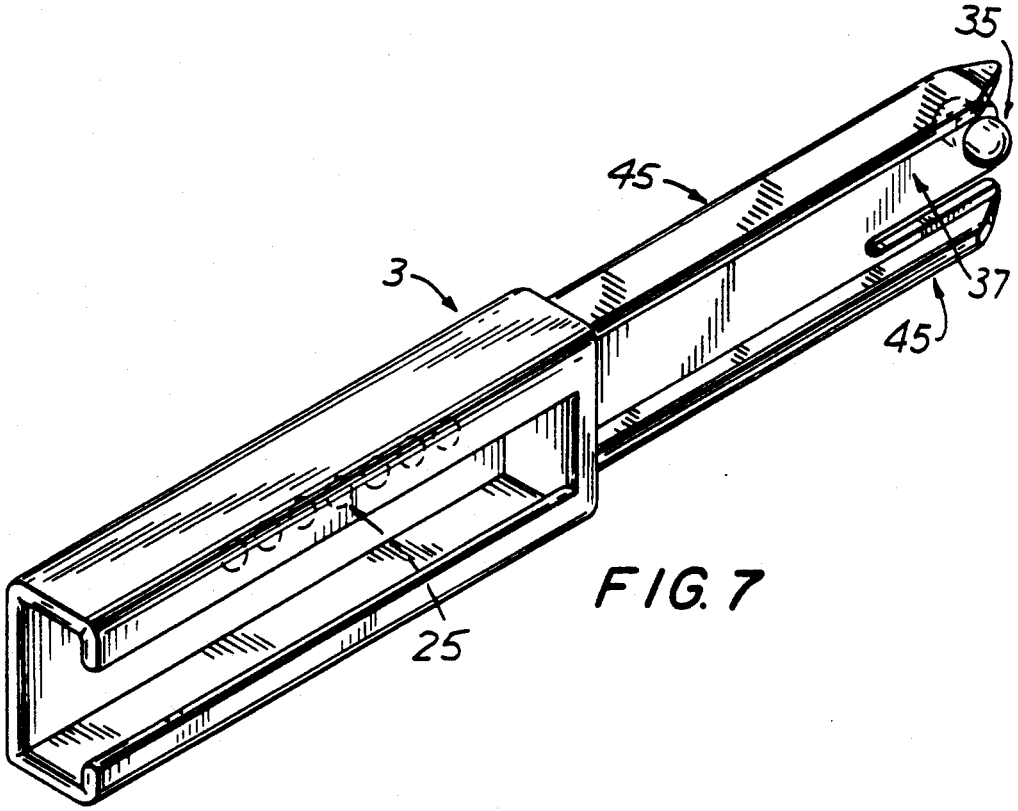
FIG. 7 is a perspective view of a valance extender of this invention.
Figure 8:
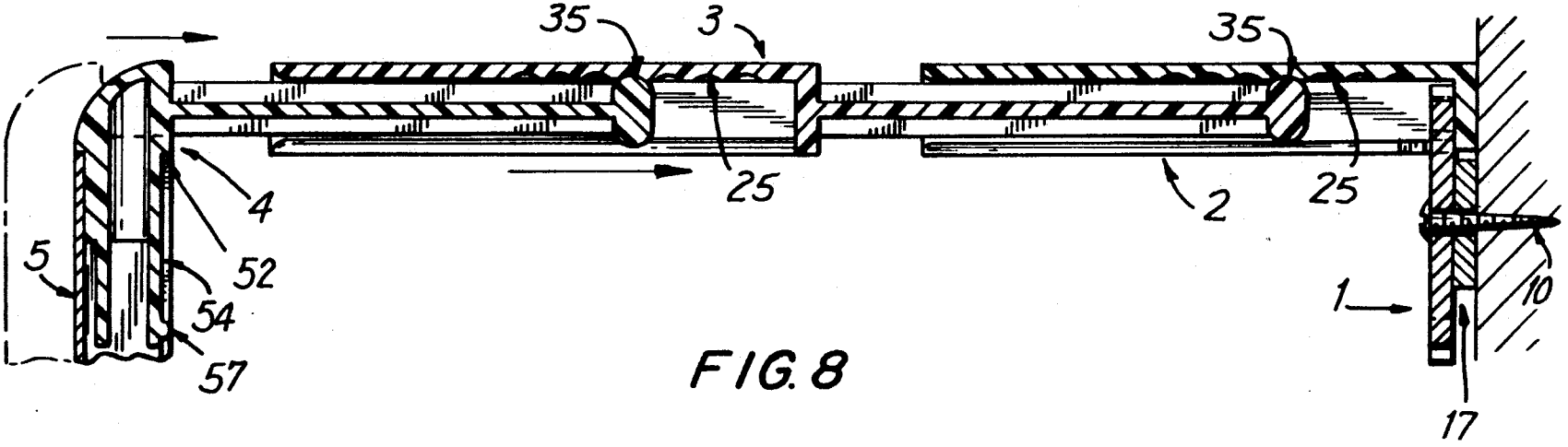
FIG. 8 is a top cross-sectional view of the curtain rod mounting assembly of this invention showing a valance extender inserted in a base member and a curtain rod bracket inserted in the valance extender.

The curtain rod mounting assembly of this invention generally comprises one or more mounting clips 1, one or more base members 2, one or more valance extenders 3 and one or more curtain rod mounting brackets 4. These components may be formed from any suitable lightweight yet strong material such as high resistance polyvinyl chloride. Although this invention will be described in terms of the various components being connected to the window frame by one mounting clip, it is to be understood that the invention contemplates the use of a plurality of mounting clips to attach a curtain rod to a window frame or other area for which the curtain is to form a closure.

Mounting clip 1 can be mounted to a window frame by a single mounting screw 10. Mounting clip 1 is provided with a pair of shoulders 15 at both ends to engage one or more base members 2. In addition, a raised portion 17 is provided along the body of mounting clip 1. Raised portion 17 contacts the window frame and compensates for the thickness of the end of base member 2 when mounting clip 1 engages base member 2. This allows for a tight and secure connection of mounting clip 1 and base member 2 to the window frame.

Base member 2 is a generally rectangular, hollow member closed at one end and open at the other end. For ease of manufacture and assembly, base member 2 preferably has an opening extending the entire length of one side. This opening allows mounting clip 1 to be inserted into base member 2. For greater flexibility, base member 2 preferably has additional slots formed perpendicular to the opening extending the entire length of one side of base member 2 adjacent the closed end of base member 2. This allows base member 2 to be positioned on mounting clip 1 even when valance extender 3 or curtain rod mounting bracket 4 already has been inserted in base member 2 as discussed more fully below.

Base member 2 is provided with means to allow precise and simple adjustment of valance extender 3 or curtain rod mounting bracket 4 in base member 2. This means may be a series of serrations or dimples 25. These serrations or dimples 25 may be raised above or lower than the inner surface of base member 2. This part of base member 2 cooperates with a portion of valance extender 3 or curtain rod mounting bracket 4 to adjust precisely and simply those components in base member 2.

Valance extenders 3 and curtain rod mounting brackets 4 have a raised rib 35 disposed at one end thereof. Preferably raised rib 35 is located at one end of a finger portion 37 formed in valance extender 3 and curtain rod mounting bracket 4. Finger portion 37 provides some flexibility to allow for easy insertion of raised rib 35 into the serrations or dimples 25. In addition, valance extenders 3 and curtain rod mounting brackets 4 preferably have two guide rails 45 that have a height substantially the same as the inside height of base member 2. Guide rails 45 properly position raised rib 35 over serrations or dimples 25 and ensure that valance extender 3 and curtain rod mounting bracket 4 fit securely in base member 2.

Valance extenders 3 also are provided with means to allow precise and simple adjustment of other valance extenders or curtain rod mounting brackets therein. This means is preferably the same means used in base members 2, namely a series of serrations or dimples 25 which may be raised above or lower than the inner surface of valance extender 3. This allows a plurality of valance extenders to be connected together to increase the distance that curtain rod mounting bracket 4 can be positioned away from the window frame. The distance that curtain rod 5 is spaced from the window can be easily adjusted by varying the particular serration or dimple 25 in which raised rib 35 of valance extender 3 or curtain rod mounting bracket 4 engages. By simply grasping valance extender 3 or curtain rod mounting bracket 4 and pushing or pulling valance extender 3 or curtain rod mounting bracket 4 into or out of base member 2 the distance that curtain rod 5 is spaced from the window can be varied and precisely adjusted.

Curtain rod mounting bracket 4 is provided with an arm 54 that slides inside of curtain rod 5 to affix curtain rod 5 to curtain rod mounting bracket 4. Arm 54 preferably has a raised portion 57 thereon that cooperates with an opening in curtain rod 5 to secure curtain rod 5 to curtain rod mounting bracket 4. Shoulder 52 on curtain rod mounting bracket 4 from which arm 54 extends ensures that curtain rod 5 fits snugly on curtain rod mounting bracket 4 and that raised portion 57 on arm 54 extends through the opening in curtain rod 5.

Since mounting clip 1 can be used to support two base members, i.e., an inner and outer base member, an additional curtain or valance treatment can be used if desired. See FIG. 1. For example, a valance treatment can be created by inserting a valance extender into the outside base member to extend one curtain rod beyond the curtain rod used in connection with the inner base member. Thus the curtain rod mounting assembly of this invention provides for increased flexibility in creating a variety of window treatments.

Thus it is seen that a curtain rod mounting assembly is provided which is relatively simple to assemble and mount on a mounting clip, that provides for relatively simple and precise adjustment to vary the distance that the curtain rod is spaced from the window opening and that obviates the necessity of using additional mounting brackets if an additional curtain or valance treatment is desired. One skilled in the art will appreciate that the present invention can be practiced by other than the described embodiments, which are presented for purposes of illustration and not of limitation, and the present invention is limited only by the claims which follow.

What is claimed is:

1. A curtain rod mounting assembly comprising:

a mounting clip for mounting to a window frame or wall;

a hollow base member having means for connecting to said mounting clip and being disposed for receiving a valance extender therein and having a serrated or dimpled portion along one inside surface of said base member;

a valance extender having means for slidably engaging with said base member and having means for cooperating with said serrated or dimpled portion of said base member for adjustably and precisely positioning said valance extender in said base member and further having a serrated or dimpled portion along one inside surface of said valance extender; and a curtain rod bracket having means for cooperating with said serrated or dimpled portion of said valance extender for adjustably and precisely positioning said curtain rod bracket in said valance extender.

2. The curtain rod mounting assembly of claim 1 further comprising one or more additional valance extenders having means for slidably connecting said valance extender and said curtain rod bracket.

3. A curtain rod mounting assembly comprising:

a mounting clip for mounting to a window frame or wall and having a first end and a second end;

a first hollow base member having means for connecting to said mounting clip at said first end and being disposed for receiving a valance extender therein and having a serrated or dimpled portion along one inside surface of said first base member;

a first valance extender having means for slidably engaging with said first base member and having means for cooperating with said serrated or dimpled portion of said first base member for adjustably and precisely positioning said first valance extender in said first base member and further having a serrated or dimpled portion along one inside surface of said first valance extender;

a first curtain rod bracket having means for slidably engaging with said first valance extender and having means for cooperating with said serrated or dimpled portion of said first valance extender for adjustably and precisely positioning said first curtain rod bracket in said first valance extender;

a second hollow base member having means for connecting to said mounting clip at said second end and being disposed for receiving a second curtain rod bracket therein and having a serrated or dimpled portion along one inside surface of said second base member; and a second curtain rod bracket having means for slidably engaging with said second base member and having means for cooperating with said serrated or dimpled portion of said second base member for adjustably and precisely positioning said second curtain rod bracket in said second base member.

4. The curtain rod mounting assembly of claim 3 further comprising one or more valance extenders having means for slidably connecting said second base member and said second curtain rod bracket.

5. The curtain rod mounting assembly of either of claims 3 or 4 further comprising one or more additional valance extenders having means for slidably connecting said first valance extender and said first curtain rod bracket.

* * * * *

UNITED STATES PATENT AND TRADEMARK OFFICE

CERTIFICATE OF CORRECTION

PATENT NO. : 5,143,336

DATED : September 1, 1992

INVENTOR(S) : Dannie L. McMichael

It is certified that error appears in the above-identified patent and that said Letters Patent is hereby corrected as shown below:

On the title page: Item [56]

Under the heading "References Cited"
after "Hinderliter" insert -- ..... 248/265 --;
after "Folker" insert -- ..... 248/265 --;
after "Darner" insert -- ..... 248/265 --; and
after "Wagner" insert -- ..... 248/265 --.

In the Abstract, line 8, after "bers" add a comma (--,--).

Signed and Sealed this

Third Day of May, 1994

Bruce Lehman

*Attest:*

BRUCE LEHMAN

*Attesting Officer*

*Commissioner of Patents and Trademarks*